US009375060B1

(12) United States Patent
Bagramyan

(10) Patent No.: US 9,375,060 B1
(45) Date of Patent: Jun. 28, 2016

(54) WEARABLE UMBRELLA WITH ENHANCED STRENGTH AND STORAGE CAPABILITY

(71) Applicant: Armenak Bagramyan, Harbor City, CA (US)

(72) Inventor: Armenak Bagramyan, Harbor City, CA (US)

( * ) Notice: Subject to any disclaimer, the term of this patent is extended or adjusted under 35 U.S.C. 154(b) by 0 days.

(21) Appl. No.: 15/040,269

(22) Filed: Feb. 10, 2016

(51) Int. Cl.
*A45B 11/02* (2006.01)
*A45B 25/02* (2006.01)
*A45B 15/00* (2006.01)
*A45B 19/04* (2006.01)

(52) U.S. Cl.
CPC ..... *A45B 11/02* (2013.01); *A45B 15/00* (2013.01); *A45B 25/02* (2013.01); *A45B 19/04* (2013.01)

(58) Field of Classification Search
CPC ..... A45B 11/00; A45B 11/02; A45B 11/04; A45B 25/00; A45B 25/02; A45B 15/00
USPC ..... 224/187, 188, 190
See application file for complete search history.

(56) References Cited

U.S. PATENT DOCUMENTS 490,229 A * 1/1893 Hohenstein et al. ... A45B 11/00 135/142
1,627,847 A * 5/1927 Harold ..... A45B 11/02 135/87
4,112,957 A * 9/1978 Biven ..... A45B 11/00 135/87
4,179,053 A * 12/1979 Figura ..... A45F 3/08 135/120.3
6,076,539 A * 6/2000 Richardson ..... A44F 3/04 135/120.3
8,851,343 B1 10/2014 Evans
8,944,300 B1 2/2015 Kaufman
2007/0262103 A1 11/2007 Blakley
2010/0313922 A1 12/2010 Raider
2013/0098410 A1* 4/2013 Prasannakumar ..... A45B 11/00 135/16

FOREIGN PATENT DOCUMENTS

JP 2009011528 A * 1/2009
JP 2010187724 A * 9/2010

* cited by examiner

*Primary Examiner* — Robert Canfield
(74) *Attorney, Agent, or Firm* — Plager Schack LLP

(57) ABSTRACT

A collapsible umbrella with enhanced strength and storage capability is worn by a user. The umbrella includes a base frame having a pair of generally vertical telescoping members coupled to a foldable support member able to rest on a shoulder of the user, an upper frame coupled to the base frame and having a pair of elongated members, each elongated member detachably coupled to one of the pair of telescoping members, a water-resistant cover member coupled to the pair of elongated members, a support skeleton having a plurality of strut members coupled to the cover member, each strut member oriented generally parallel to other members of the plurality of strut members, and a plurality of tension cables connecting the base frame to both the upper frame and the water-resistant member.

8 Claims, 4 Drawing Sheets

WEARABLE UMBRELLA WITH ENHANCED STRENGTH AND STORAGE CAPABILITY

BACKGROUND

The embodiments herein relate generally to umbrellas and/or canopy devices designed to protect users from the sun, rain, snow, other precipitation, and the like.

Conventional umbrellas are foldable canopies supported by a pole and handle. Although these devices are effective in protecting the user from precipitation and other environmental elements, the user is required to hold the umbrella with one or both hands during use. This is disadvantageous because the user's hands are not free to perform other tasks when using the umbrella.

Several wearable umbrella and/or shade devices exist as disclosed in U.S. Pat. Nos. 8,851,343 and 8,944,300, and U.S. Patent Application Publications 2010/0313922 and 2007/026103, These devices generally comprise cover members secured to the user's body by a combination of support members and/or straps. However, these wearable umbrellas and shade devices are limited because their cover members lack the structural support to withstand strong winds or precipitation and/or the devices do not easily collapse into a storage position when not in use.

As such, there is a need in the industry for a wearable umbrella with enhanced strength and storage capability that overcomes the limitations of the prior art.

SUMMARY

A collapsible umbrella with enhanced strength and storage capability configured to be worn by a user is provided. The umbrella comprises a base frame comprising a pair of generally vertical telescoping members coupled to a foldable support member configured to rest on a shoulder of the user, an upper frame coupled to the base frame and comprising a pair of elongated members, each elongated member detachably coupled to one of the pair of telescoping members, a water-resistant cover member coupled to the pair of elongated members, a support skeleton comprising a plurality of strut members coupled to the cover member, each strut member oriented generally parallel to other members of the plurality of strut members, and a plurality of tension cables connecting the base frame to both the upper frame and the water-resistant member, wherein the elongated members are coupled to the telescoping members and adjusted to an operational position to place the water-resistant cover member above ahead of the user, wherein the elongated members are detached from the telescoping members to permit the base frame, upper frame, support skeleton and cover member to collapse into a storage position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
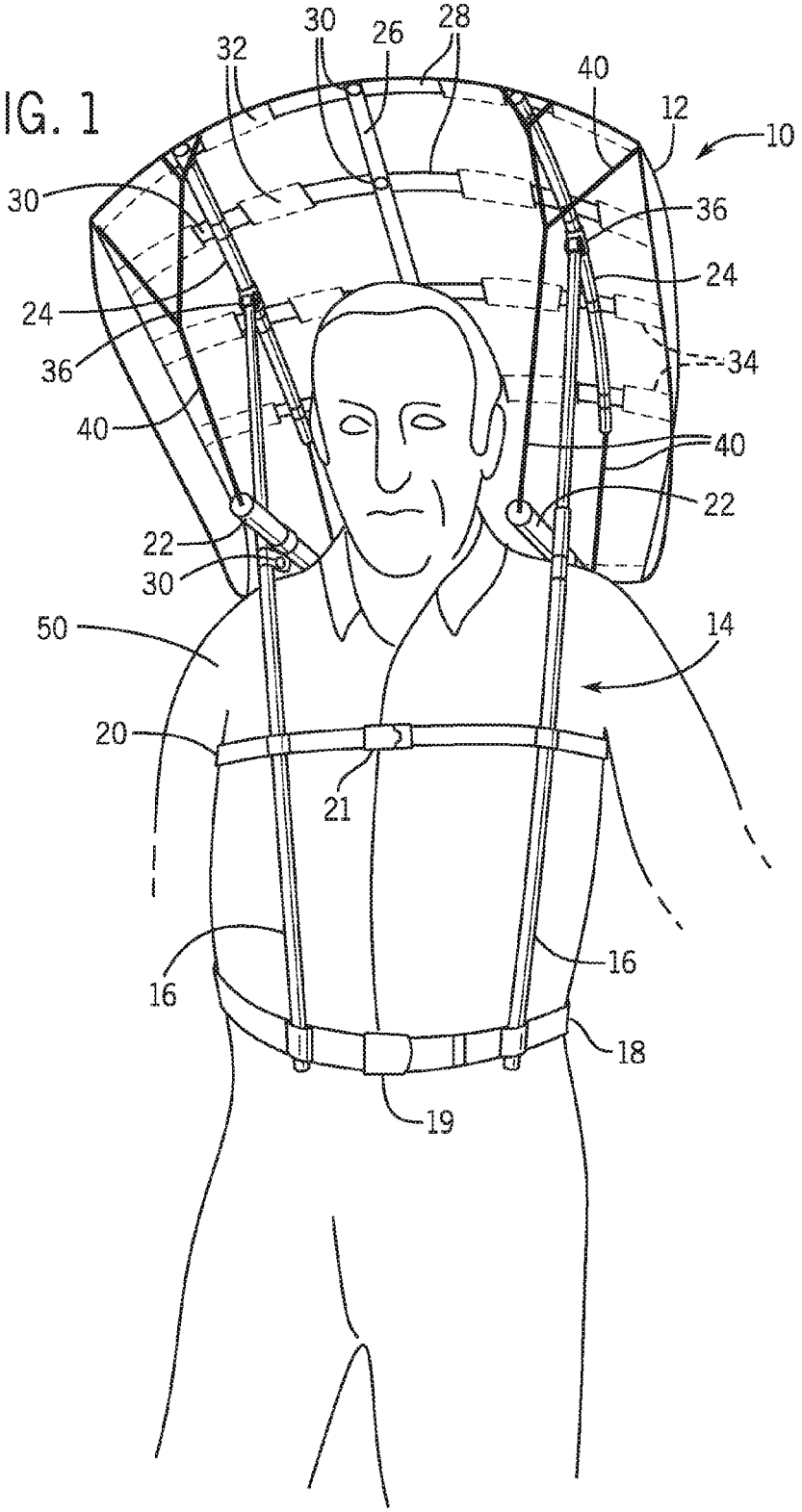
FIG. 1 depicts a perspective view of certain embodiments of the collapsible umbrella in use.
Figure 2:
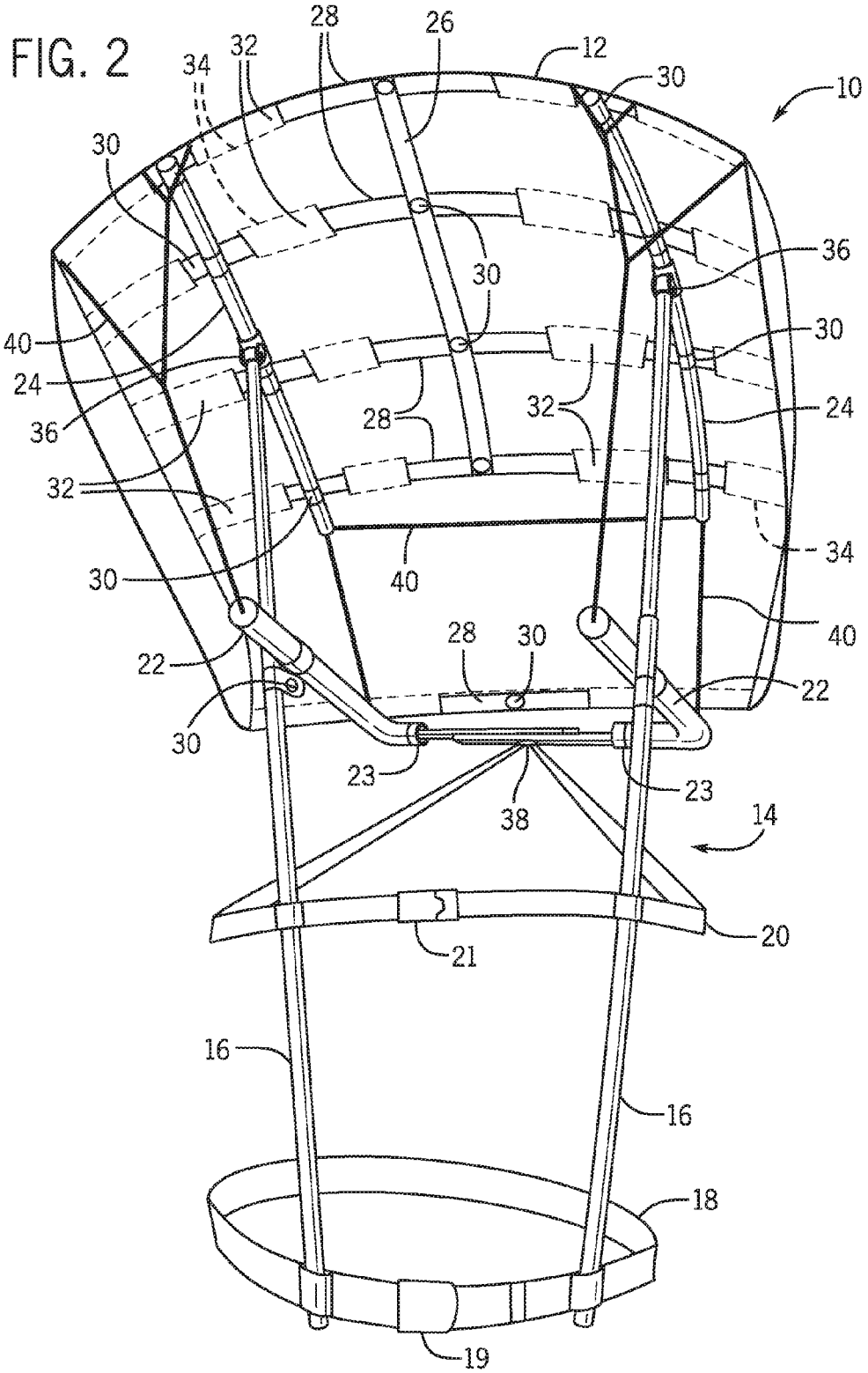
FIG. 2 depicts a front perspective view of certain embodiments of the collapsible umbrella.

As depicted in FIGS. 1-2, wearable umbrella 10 generally comprises frame assembly 14, chest strap 20, belt 18 and fabric 12, and is configured to be worn by operator 50 to protect the operator from the sun, rain, snow, sleet, other precipitation, or the like. When not in use, wearable umbrella 10 is removed from operator 50 and folded to a collapsed configuration to store the umbrella.

Frame assembly 14 of wearable umbrella 10 comprises a pair of telescoping vertical frame members 16, foldable shoulder rest member 22, and articulated upper struts 24. Each telescoping vertical frame member 16 comprises any combination of tubular members and/or rods that are slidably adjusted relative to each other to extend or compress the telescoping vertical frame member. This permits telescoping vertical frame members 16 to be adjusted to a desired height to accommodate the size of operator 50. Once a desired height of each telescoping vertical frame member 16 is achieved, the corresponding tubular members and/or rods are locked into place by one or more fastening components such as locking pins, which are inserted through holes in the corresponding tubular members and/or rods.

Telescoping vertical frame members 16 are oriented generally parallel to each other and are coupled to foldable shoulder rest member 22 by articulated connection components 30. Articulated connection components 30 may comprise any fastening components such as locking pins, clips, or the like, and may permit pivotable movement of components connected thereto. Foldable shoulder rest member 22 comprises two symmetric halves pivotably mounted together at pivot point 38. In one embodiment, locking collars 23 are coupled to symmetric halves of foldable shoulder rest member 22 to help secure the components in place.

In one embodiment, chest strap 20 is coupled to telescoping vertical frame members 16 and pivot point 38, and comprises chest strap buckle 21. Chest strap 20 is configured to be disposed around operator 50 above a chest region. Belt 18 is coupled to telescoping vertical frame members 16 and comprises belt buckle 19. Belt 18 is configured to be disposed around operator 50 above a waist region.

A pair of articulated upper struts 24 is detachably coupled to telescoping vertical frame members 16 by fastening components 36, which may include any combination of clips, locking pins, pipe connector fittings, or the like. Fabric 12 is coupled to articulated upper struts 24 and is configured to cover the top of operator 50. Fabric 12 is preferably made from a water-resistant material. In one embodiment, fabric 12 may prevent ultraviolet rays from passing through, thereby shielding operator 50 from harmful rays.

A support skeleton is coupled to the interior of fabric 12 and comprises a plurality of primary struts 28 and central spine 26. In a preferred embodiment, five primary struts 28 are oriented generally parallel to each other and positioned horizontally when fabric 12 is deployed above the operator's head. In one embodiment, one or more primary struts 28 are disposed through sleeves 32, which are secured to fabric 12 by stitching 34. Central spine 26 is coupled to four primary struts 28 by articulated connection components 30. Articulated connection components 30 may comprise any fastening components such as locking pins, clips, or the like, which permit pivotable movement of components connected thereto. As a result, primary struts 28 can pivot relative to central spine 26 when fabric 12 is deployed or collapsed.

One or more tension cables 40 are used to secure fabric 12, foldable shoulder rest member 22 and articulated upper struts 24 together. In one embodiment, at least one tension cable 40 is coupled to each half of foldable shoulder rest member 22 and fabric member 12. In one embodiment, at least one tension cable 40 is coupled to each articulated upper strut 24 and foldable shoulder rest member 22. In one embodiment, at least one tension cable is coupled to both articulated upper struts 24. However, it shall be appreciated that alternative numbers and configurations of tension cables 40 may be used to secure wearable umbrella 10 in place. Tension cables 40 may comprise any combination of ropes, ribbons, elastic bands, or the like. It shall be appreciated that tension cables 40 enhance the strength and stability of wearable umbrella 10 when in use.

Figure 3:
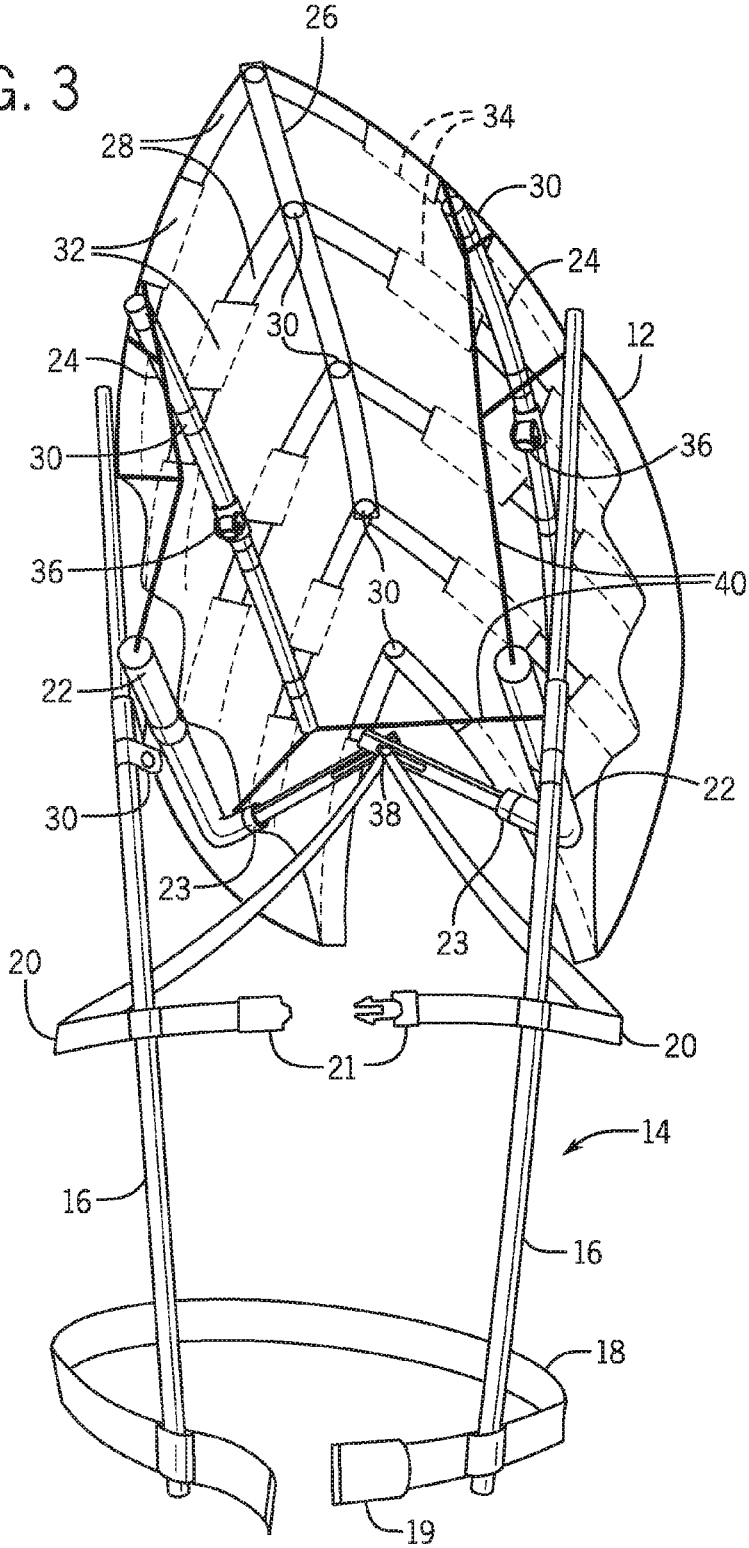
FIG. 3 depicts a front perspective view of certain embodiments of the collapsible umbrella illustrating a partially collapsed configuration.
Figure 4:
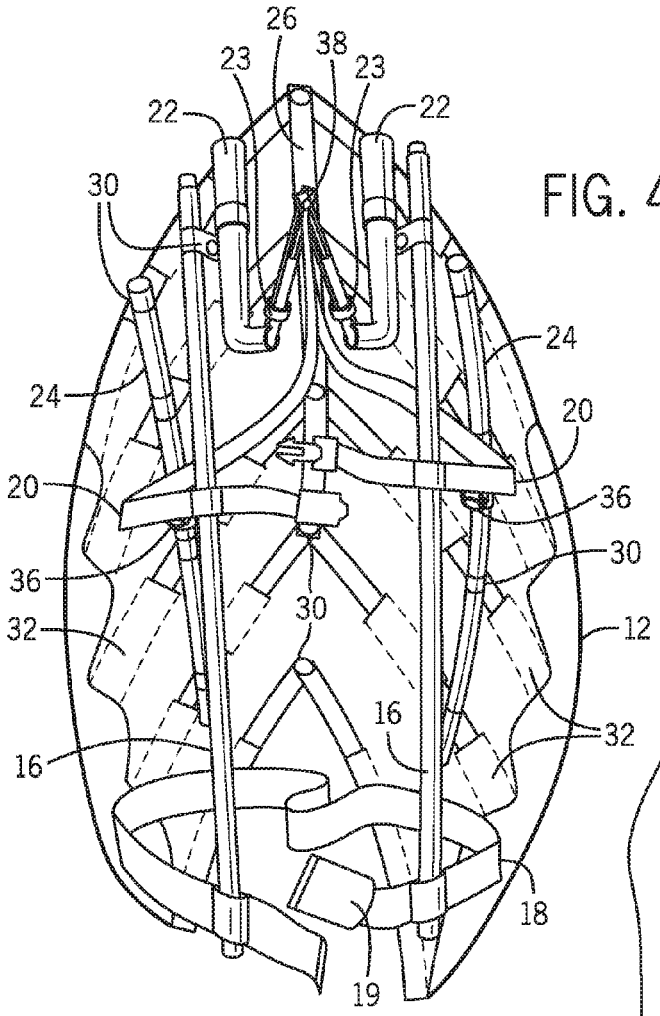
FIG. 4 depicts a front perspective view of certain embodiments of the collapsible umbrella illustrating a collapsed configuration.
Figure 5:
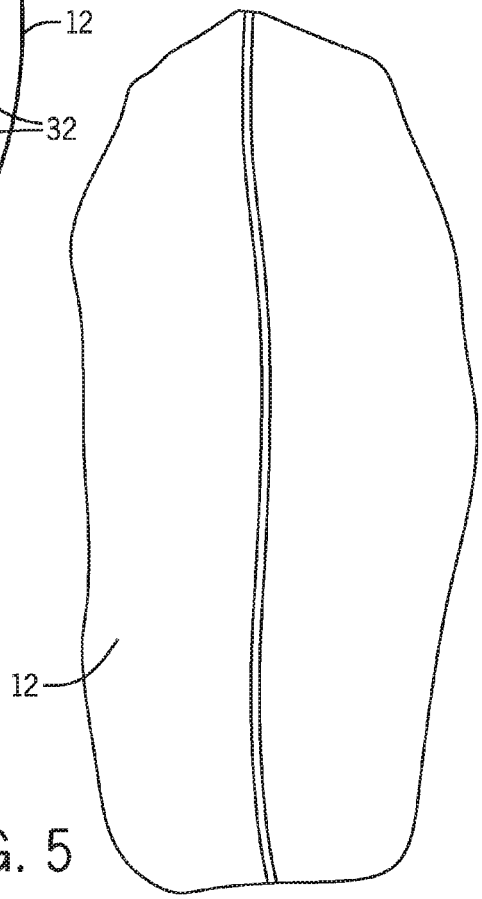
FIG. 5 depicts a perspective view of certain embodiments of the collapsible umbrella illustrating a completely collapsed storage configuration.

In operation, wearable umbrella 10 is deployed and secured to operator 50 as shown in FIG. 1. Specifically, foldable shoulder rest member 22 is disposed on top of the shoulders. Chest strap 20 is secured around operator 50 and above a chest region. Belt 18 is secured around operator 50 and above a waist region. In this deployed configuration, fabric 12 protects the user from sun, rain, snow, sleet, other precipitation, or the like. To store wearable umbrella 10, chest strap 20 and belt 18 are each disengaged to remove the umbrella from operator 50. As depicted in FIG. 3, wearable umbrella 10 is partially collapsed by detaching telescoping vertical frame members 16 from articulated upper struts 24. This permits halves of foldable shoulder rest member 22 to pivot and primary struts 28 to pivot relative to central spine 26. Telescoping vertical frame members 16 can be compressed further to permit wearable umbrella 10 to further collapse as shown in FIG. 4. In a fully collapsed position, fabric 12 is tucked around the components of wearable umbrella 10 in a storage position as shown in FIG. 5.

Wearable umbrella 10 is advantageous because it is light weight and allows the user mm a wide variety of activities. For example, wearable umbrella 10 can be worn over the head when the user bikes, runs, hikes, walks both indoors and outdoors, and the like. Wearable umbrella 10 is designed to be waterproof and can be worn when the user walks on the beach, in and out of the water. Wearable umbrella 10 can also serve as a protective helmet. For example, construction workers can wear wearable umbrella 10 to protect their heads from sun, wind, rain, flying debris, and the like.

It shall be appreciated that the components of wearable umbrella 10 described in several embodiments herein may comprise any known materials in the field and be of any color, size and/or dimensions. For example, components of wearable umbrella 10 may be made from plastic, wood, metal, or the like. It shall be appreciated that the components of wearable umbrella 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A collapsible umbrella with enhanced strength and storage capability configured to be worn by a user, the umbrella comprising:

a base frame comprising a pair of generally vertical telescoping members coupled to a foldable support member configured to rest on a shoulder of the user;

an upper frame coupled to the base frame and comprising a pair of elongated members, each elongated member detachably coupled to one of the pair of telescoping members;

a water-resistant cover member coupled to the pair of elongated members;

a support skeleton comprising a plurality of strut members coupled to the cover member, each strut member oriented generally parallel to other members of the plurality of strut members; and a plurality of tension cables connecting the base frame to both the upper frame and the water-resistant member;

wherein the elongated members are coupled to the telescoping members and adjusted to an operational position to place the water-resistant cover member above a head of the user, wherein the elongated members are detached from the telescoping members to permit the base frame, upper frame, support skeleton and cover member to collapse into a storage position.

2. The collapsible umbrella of claim 1, wherein the support skeleton further comprises a spine member coupled to central portions of the plurality of strut members, wherein each strut member of the plurality of strut members is configured to pivot relative to the spine member.

3. The collapsible umbrella of claim 2, wherein each strut member of the plurality of strut members is disposed through at least one sleeve coupled to the water-resistant cover member.

4. The collapsible umbrella of claim 3, wherein the plurality of tension cables comprises at least one tension cable coupled to the foldable support member and the water-resistant member and at least one tension cable coupled to the foldable support member and at least one of the elongated members.

5. The collapsible umbrella of claim 4, further comprising a first strap coupled to the foldable support member and telescoping members, wherein the first strap is configured to be disposed around a chest region of the user.

6. The collapsible umbrella of claim 5, wherein the first strap comprises a buckle.

7. The collapsible umbrella of claim 6, further comprising a second strap coupled to the telescoping members and configured to be disposed around a waist region of the user.

8. The collapsible umbrella of claim 7, wherein the second strap is a belt comprising a buckle.

* * * * *